US007635283B1

(12) United States Patent
Islam

(10) Patent No.: US 7,635,283 B1
(45) Date of Patent: Dec. 22, 2009

(54) CONNECTOR WITH RETAINING RING FOR COAXIAL CABLE AND ASSOCIATED METHODS

(75) Inventor: Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/277,172

(22) Filed: Nov. 24, 2008

(51) Int. Cl.
*H01R 9/05* (2006.01)

(52) U.S. Cl. ..... 439/583

(58) Field of Classification Search ..... 439/583, 439/578, 584–587, 271–275, 441, 460
See application file for complete search history.

(56) References Cited

U.S. PATENT DOCUMENTS

| | | | | |
|---|---|---|---|---|
| 3,040,288 | A | 6/1962 | Edlen et al. | 339/103 |
| 3,103,548 | A | 9/1963 | Concelman | 174/89 |
| 3,106,599 | A | 10/1963 | Leitner et al. | 174/12 |
| 3,671,926 | A | 6/1972 | Nepovim | 339/177 E |
| 3,744,011 | A | 7/1973 | Blanchenot | 339/177 R |
| 3,757,279 | A | 9/1973 | Winston | 339/177 R |
| 3,761,870 | A | 9/1973 | Drezin et al. | 339/177 R |
| 3,847,463 | A | 11/1974 | Hayward et al. | 339/8 P |
| 3,915,539 | A | 10/1975 | Collins | 339/94 C |
| 4,046,451 | A | 9/1977 | Juds et al. | 339/177 R |
| 4,491,685 | A | 1/1985 | Drew et al. | 174/75 C |
| 4,557,546 | A | 12/1985 | Dreyer | 339/177 R |
| 4,585,289 | A | 4/1986 | Bocher | 339/89 C |
| 4,676,577 | A | 6/1987 | Szegda | 439/584 |
| 4,915,651 | A | 4/1990 | Bout | 439/578 |
| 4,923,412 | A | 5/1990 | Morris | 439/578 |
| 5,137,470 | A | 8/1992 | Doles | 439/578 |
| 5,154,636 | A | 10/1992 | Vaccaro et al. | 439/583 |
| 5,267,877 | A | 12/1993 | Scannelli et al. | 439/584 |
| 5,281,167 | A | 1/1994 | Le et al. | 439/578 |
| 5,352,127 | A | 10/1994 | Muller et al. | 439/188 |
| 5,352,134 | A | 10/1994 | Jacobsen et al. | 439/584 |
| 5,509,821 | A | 4/1996 | Small et al. | 439/272 |
| 5,545,059 | A | 8/1996 | Nelson | 439/583 |
| 5,576,675 | A | 11/1996 | Oldfield | 333/260 |
| 5,722,856 | A | 3/1998 | Fuchs et al. | 439/578 |
| 5,785,554 | A | 7/1998 | Ohshiro | 439/584 |
| 5,795,188 | A | 8/1998 | Harwath | 439/583 |
| 5,830,009 | A | 11/1998 | Tettinger | 439/578 |

(Continued)

OTHER PUBLICATIONS

Paynter, "Coupling Nut With Cable Jacket Retention," Jun. 29, 2008, pp. 1-20.

(Continued)

*Primary Examiner*—Chandrika Prasad
(74) *Attorney, Agent, or Firm*—Allen, Dyer, Doppelt, Milbrath & Gilchrist, P.A.

(57) ABSTRACT

A coaxial cable connector includes a back nut to be secured onto the coaxial cable and a connector housing to be coupled to the back nut. A center contact is to be coupled to the inner conductor. At least one insulator member is within the connector housing for carrying the center contact. Furthermore, a sealing ring is carried within the back nut. Also, a retaining ring is carried within the back nut rearwardly of the sealing ring and has a ring base and a plurality of fingers extending forwardly therefrom so that the sealing ring overlaps the plurality of fingers and urges the plurality of fingers radially inwardly onto the coaxial cable to thereby secure the back nut onto the coaxial cable.

29 Claims, 19 Drawing Sheets

U.S. PATENT DOCUMENTS

| | | | | |
|---|---|---|---|---|
| 5,938,474 | A | 8/1999 | Nelson | 439/583 |
| 6,019,636 | A | 2/2000 | Langham | 439/584 |
| 6,109,964 | A | 8/2000 | Kooiman | 439/583 |
| 6,133,532 | A | 10/2000 | Lundback et al. | 174/88 C |
| 6,148,513 | A | 11/2000 | Schiefer et al. | 29/858 |
| 6,203,368 | B1 | 3/2001 | Weidner | 439/579 |
| 6,267,621 | B1 | 7/2001 | Pitschi et al. | 439/584 |
| 6,309,250 | B1 | 10/2001 | Hyzin | 439/578 |
| 6,332,808 | B1 | 12/2001 | Kanda et al. | 439/584 |
| 6,386,915 | B1 | 5/2002 | Nelson | 439/584 |
| 6,396,367 | B1 | 5/2002 | Rosenberger | 333/260 |
| 6,439,924 | B1 | 8/2002 | Kooiman | 439/578 |
| 6,462,637 | B1 | 10/2002 | Laverick | 336/107 |
| 6,607,398 | B2 | 8/2003 | Henningsen | 439/578 |
| 6,668,459 | B2 | 12/2003 | Henningsen | 30/90.2 |
| 6,692,300 | B2 | 2/2004 | Kanda et al. | 439/583 |
| 6,793,529 | B1 | 9/2004 | Buenz | 439/583 |
| 6,802,739 | B2 | 10/2004 | Henningsen | 439/584 |
| 6,808,415 | B1 | 10/2004 | Montena | 439/584 |
| 6,824,415 | B2 | 11/2004 | Wlos | 439/348 |
| 6,835,095 | B2 | 12/2004 | Chen | 439/578 |
| 6,848,931 | B2 | 2/2005 | McMullen et al. | 439/350 |
| 6,848,939 | B2 | 2/2005 | Stirling | 439/578 |
| 6,848,941 | B2 | 2/2005 | Wlos et al. | 439/585 |
| 6,863,565 | B1 | 3/2005 | Kogan et al. | 439/580 |
| 6,893,290 | B2 | 5/2005 | Buenz et al. | 439/578 |
| 6,926,555 | B2 | 8/2005 | Nelson | 439/578 |
| 6,939,169 | B2 | 9/2005 | Islam et al. | 439/578 |
| 7,001,546 | B2 | 3/2006 | Vaccaro | 439/580 |
| 7,008,264 | B2 | 3/2006 | Wild | 439/578 |
| 7,059,162 | B1 | 6/2006 | Tarpill et al. | 72/112 |
| 7,077,700 | B2 | 7/2006 | Henningsen | 439/583 |
| 7,104,839 | B2 | 9/2006 | Henningsen | 439/578 |
| 7,121,883 | B1 | 10/2006 | Petersen et al. | 439/582 |
| 7,134,189 | B2 | 11/2006 | Buenz et al. | 29/748 |
| 7,144,272 | B1 | 12/2006 | Burris et al. | 439/578 |
| 7,156,696 | B1 | 1/2007 | Montena | 439/584 |
| 7,163,420 | B2 | 1/2007 | Montena | 439/578 |
| 7,179,121 | B1 | 2/2007 | Burris et al. | 439/578 |
| 7,275,957 | B1 * | 10/2007 | Wlos et al. | 439/583 |
| 7,309,255 | B2 * | 12/2007 | Rodrigues | 439/578 |
| 7,329,149 | B2 | 2/2008 | Montena | 439/584 |
| 7,335,059 | B2 | 2/2008 | Vaccaro | 439/578 |
| 7,381,089 | B2 | 6/2008 | Hosler, Sr. | 439/578 |
| 7,422,477 | B2 | 9/2008 | Eriksen | 439/578 |
| 7,435,135 | B2 | 10/2008 | Wlos | 439/584 |
| 7,448,906 | B1 | 11/2008 | Islam | 439/578 |
| 2005/0118865 | A1 | 6/2005 | Henningsen | 439/578 |
| 2006/0112549 | A1 | 6/2006 | Henningsen | 29/857 |
| 2007/0149047 | A1 | 6/2007 | Wild et al. | 439/578 |
| 2009/0053931 | A1 | 2/2009 | Islam | 439/578 |
| 2009/0186521 | A1 | 7/2009 | McMullen et al. | 439/578 |

OTHER PUBLICATIONS

Paynter, "Coaxial Connector Inner Contact Arrangement," Jul. 15, 2008, pp. 1-17.
Paynter, "Insertion Coupling Coaxial Connector," Nov. 3, 2008, pp. 1-24.
Paynter, "Low PIM Rotatable Connector," Jan. 29, 2009, pp. 1-17.
Islam, "Axial Compression Connector," Nov. 3, 2008, pp. 1-25.
Islam, "Flaring Coaxial Cable End Preparation Tool And Associated Methods", Nov. 24, 2008, pp. 1-32.
Islam, "Connector Including Compressible Ring for Coaxial Cable and Associated Methods," Nov. 24, 2008, pp. 1-30.
Islam, "Connector With Positive Stop and Compressible Ring for Coaxial Cable and Associated Methods," Nov. 24, 2008, pp. 1-25.
Islam, "Connector With Positive Stop For Coaxial Cable and Associated Methods". Nov. 24, 2008, pp. 1-22.
Islam, "Connector Including Flexible Fingers and Associated Methods," Jan. 28, 2009, pp. 1-26.
Islam, "Inner Conductor Sealing Insulator for Coaxial Connector," Oct. 7, 2008, pp. 1-17.
Islam, "Inner Contact Supporting and Biasing Insulator," Jan. 29, 2009, pp. 1-16.

* cited by examiner

CONNECTOR WITH RETAINING RING FOR COAXIAL CABLE AND ASSOCIATED METHODS

FIELD OF THE INVENTION

The present invention relates to the field of connectors for cables, and, more particularly, to connectors for coaxial cables and related methods.

BACKGROUND OF THE INVENTION

Coaxial cables are widely used to carry high frequency electrical signals. Coaxial cables enjoy a relatively high bandwidth, low signal losses, are mechanically robust, and are relatively low cost. One particularly advantageous use of a coaxial cable is for connecting electronics at a cellular or wireless base station to an antenna mounted at the top of a nearby antenna tower. For example, the transmitter located in an equipment shelter may be connected to a transmit antenna supported by the antenna tower. Similarly, the receiver is also connected to its associated receiver antenna by a coaxial cable path.

A typical installation includes a relatively large diameter coaxial cable extending between the equipment shelter and the top of the antenna tower to thereby reduce signal losses. Some coaxial cables include a smooth outer conductor while other coaxial cables instead have a corrugated outer conductor. These coaxial cables also have an inner conductor and a dielectric between the outer conductor and the inner conductor. Some inner conductors are hollow, while other inner conductors are formed around an inner conductor dielectric core.

A typical connector for such a coaxial cable includes a connector housing to make an electrical connection to the outer conductor and a center contact to make electrical connection to the inner conductor of the coaxial cable. Such a connector may also include a back nut that is positioned onto the end of the outer conductor and adjacent the outer insulating jacket portion of the coaxial cable.

U.S. Pat. No. 5,795,188 to Harwath, for example, discloses a connector for a coaxial cable having a corrugated outer conductor. The connector includes a connector housing defining a radially outer ramp to contact the inside surface of a flared end portion of an outer conductor of the coaxial cable. A clamping ring is in the corrugation adjacent to the flared end portion of the outer conductor. The clamping ring presses the outer surface of the outer conductor against the radially outer ramp to provide electrical contact therebetween.

U.S. Pat. No. 7,011,546 to Vaccaro discloses a connector for a coaxial cable having a smooth outer conductor. The connector includes a connector housing, a back nut threadingly engaging a rearward end of the connector housing, a ferrule gripping and advancing an end of the coaxial cable into the connector housing as the back nut is tightened, and an insulator member positioned within a medial portion of the connector housing. The insulator member has a bore extending therethrough and includes a forward disk portion, a rearward disk portion, a ring portion connecting the forward and disk portions together, and a tubular outer conductor support portion extending rearwardly from the rearward disk portion for supporting an interior surface of the outer conductor of the coaxial cable.

U.S. Pat. No. 7,077,700 to Henningsen discloses a coaxial cable connector including a removable back nut, an outer body, and a center conductor supported within the outer body by a dielectric. An uncompressible clamp ring is rotatably disposed within the central bore of the back nut. A prepared end of a coaxial cable is inserted through the back nut, and the end portion of the outer conductor of the coaxial cable is flared outwardly. As the back nut is tightened onto the outer body, the flared end of the outer conductor is clamped between mating clamping surfaces formed on the clamp ring and the outer body.

Despite these developments in connector technology, a need remains for connectors that may facilitate easy installation and that may retain a good electrical contact with the coaxial cable under a variety of operating conditions. Further, a need remains for connectors that may be securely attached to a coaxial cable and that are sealed against debris and moisture.

SUMMARY OF THE INVENTION

In view of the foregoing background, it is therefore an object of the present invention to provide a coaxial cable connector that can be securely located on a coaxial cable and has features to seal against debris and moisture.

This and other objects, features, and advantages in accordance with the present invention are provided by a coaxial cable connector to be attached to a coaxial cable comprising an inner conductor, an outer conductor, and a dielectric therebetween. The coaxial cable connector may comprise a back nut to be secured onto the coaxial cable and a connector housing to be coupled to said back nut. A center contact may be coupled to the inner conductor. Furthermore, at least one insulator member may be within the connector housing for carrying said center contact.

A sealing ring may be carried within said back nut. The sealing ring advantageously seals the back nut and coaxial cable from debris and moisture.

A retaining ring may also be carried within said back nut rearwardly of said sealing ring and may comprise a ring base and a plurality of fingers extending forwardly therefrom so that said sealing ring overlaps said plurality of fingers and urges said plurality of fingers radially inwardly onto the coaxial cable to thereby secure said back nut onto the coaxial cable. The retaining ring securely attaches the back nut on the coaxial cable. Further, if the coaxial cable has a jacket, the retaining ring allows attachment of the back nut on the coaxial cable without scoring of the jacket.

The back nut and said retaining ring may have respective portions defining an interference fit locking arrangement therebetween. This helps to positively locate and retain the retaining ring in the back nut.

The back nut may have an annular groove defined on a radially inner surface thereof and the retaining ring may further comprise a retaining projection extending radially outwardly from said ring base into the annular groove. The retaining projection and annular groove may define the interference fit locking arrangement. Alternatively, a retaining projection may extend radially inwardly from the back nut and an annular groove may be defined on a radially outer surface of the ring base.

The ring base may comprise a continuous annular ring base. The sealing ring may comprise a radially inwardly extending forward end to seal against an exposed portion of the outer conductor of the coaxial cable. This may protect the outer conductor from corrosion caused by debris and moisture. The coaxial cable further comprises a jacket surrounding the outer conductor the sealing ring may comprise a radially inwardly extending forward end to seal against an exposed portion of the jacket.

Each of the plurality of fingers of the retaining ring may have a rectangular shape. The sealing ring may comprise an elastomeric material or a polymer material. The retaining ring may comprise an electrically insulating plastic material.

The connector housing may define a ramp to receive the outer conductor thereagainst. The ramp may have a first portion and a second portion and an angle of the first portion with respect to a longitudinal axis of the connector housing may be less than an angle of the second portion with respect to the longitudinal axis of the connector housing.

Alternatively, the back nut may define a ramp to receive the outer conductor thereagainst. A clamping ring may compressibly clamp against the outer conductor opposite the ramp when the connector housing and back nut are engaged. The clamping ring may comprise an electrically conductive compressible coil spring having an axis coaxial with said connector housing.

The ramp may have a stair-stepped shape. This stair-stepped shape may present an increased friction surface to the outer conductor to help prevent unwanted movement of the outer conductor. This stair-stepped shape may also enhance the electrical contact with the outer conductor.

This clamping ring advantageously provides secure mechanical and electrical connections between the outer conductor and the connector housing. Furthermore, this maintains a sufficient clamping force on the outer conductor opposite the radially outer ramp even if the size and/or shape of the outer conductor changes due to thermal expansion or aluminum creep.

The connector housing and the back nut may include respective portions defining a positive stop when fully engaged. The positive stop may allow the connector to be attached to the coaxial cable without a torque wrench or other torque limiting tool, as the positive stop indicates to the installer when to stop tightening the back nut and the connector housing together.

The connector housing may comprise an enlarged diameter tool engaging portion and wherein the back nut may comprise a forward end. The positive stop may be defined by the enlarged diameter tool engaging portion and the forward end. The back nut may comprise a polymer composite back nut.

The outer conductor of the coaxial cable may comprise a corrugated outer conductor or a smooth outer conductor. Indeed, in some applications, the connector may accommodate both corrugated and smooth outer conductors. This advantageously allows a same connector to be used for multiple cable types.

Another aspect is directed to a method of making a coaxial cable connector to be attached to a coaxial cable comprising an inner conductor, an outer conductor, and a dielectric therebetween. The method may comprise forming a back nut to be secured onto the coaxial cable and forming a connector housing to be coupled to the back nut. At least one insulator member may be formed to be positioned in the connector housing to carry a center contact to be coupled to the inner conductor. A sealing ring may be formed to be positioned within the back nut. A retaining ring may be formed to be positioned in the back nut rearwardly of the sealing ring and may comprise a ring base and a plurality of fingers extending forwardly therefrom so that the sealing ring overlaps the plurality of fingers and urges the plurality of fingers radially inwardly onto the coaxial cable to thereby secure the back nut onto the coaxial cable.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation and double prime notation are used to indicate similar elements in alternative embodiments.

Figure 1:
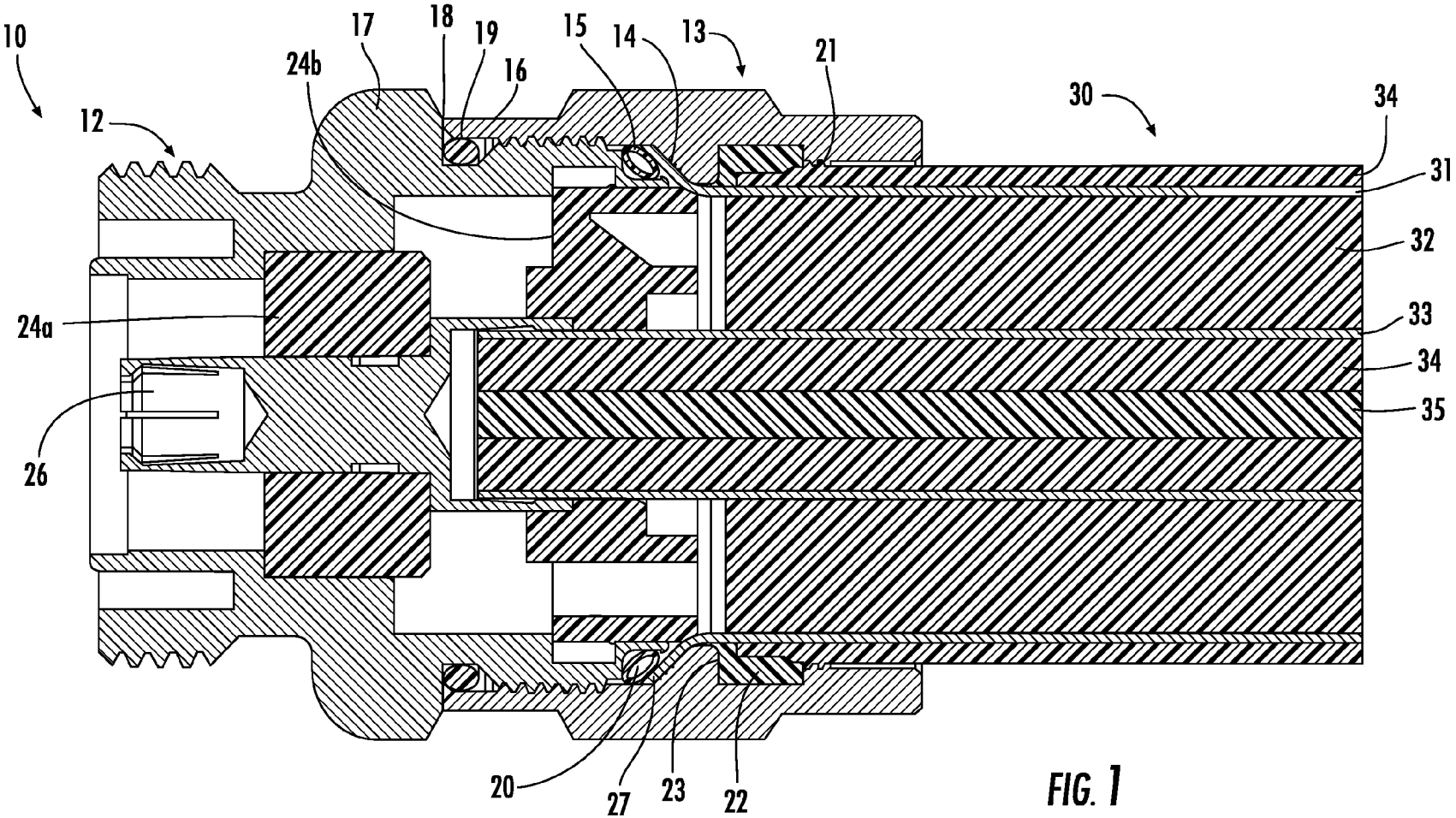
FIG. 1 is a longitudinal cross-sectional view of a connector installed on the end of a coaxial cable having a smooth outer conductor in accordance with the present invention.

Referring initially to FIG. 1, a connector 10 attached to a coaxial cable 30 is now described. The coaxial cable 30 comprises an inner conductor 33, an outer conductor 31, and a dielectric 32 therebetween. The inner conductor 33 is a hollow inner conductor with an inner conductor filament 35, and an inner conductor dielectric 34 therebetween. The outer conductor 31 is illustratively a smooth outer conductor with a flared end 27, but could be a corrugated outer conductor in other embodiments. The dielectric 32 may be a foam dielectric or other dielectric as known to those skilled in the art.

The connector 10 includes an internally threaded back nut 13 to receive an externally threaded rearward end of a connector housing 12. A forward oaring 19 and a rearward sealing ring 22 are illustratively provided to seal respective forward and rearward interfaces adjacent the back nut 13 and reduces or prevents moisture ingress. The sealing ring 22 illustratively has a radially inwardly extending forward end 23 to seal against an exposed portion of the outer conductor 31. This radially inwardly extending forward end 23 also seals against the jacket 34. Of course, the o-ring 19 and the rearward sealing ring 22 may be gaskets, as will be appreciated by one of skill in the art.

Figure 19:
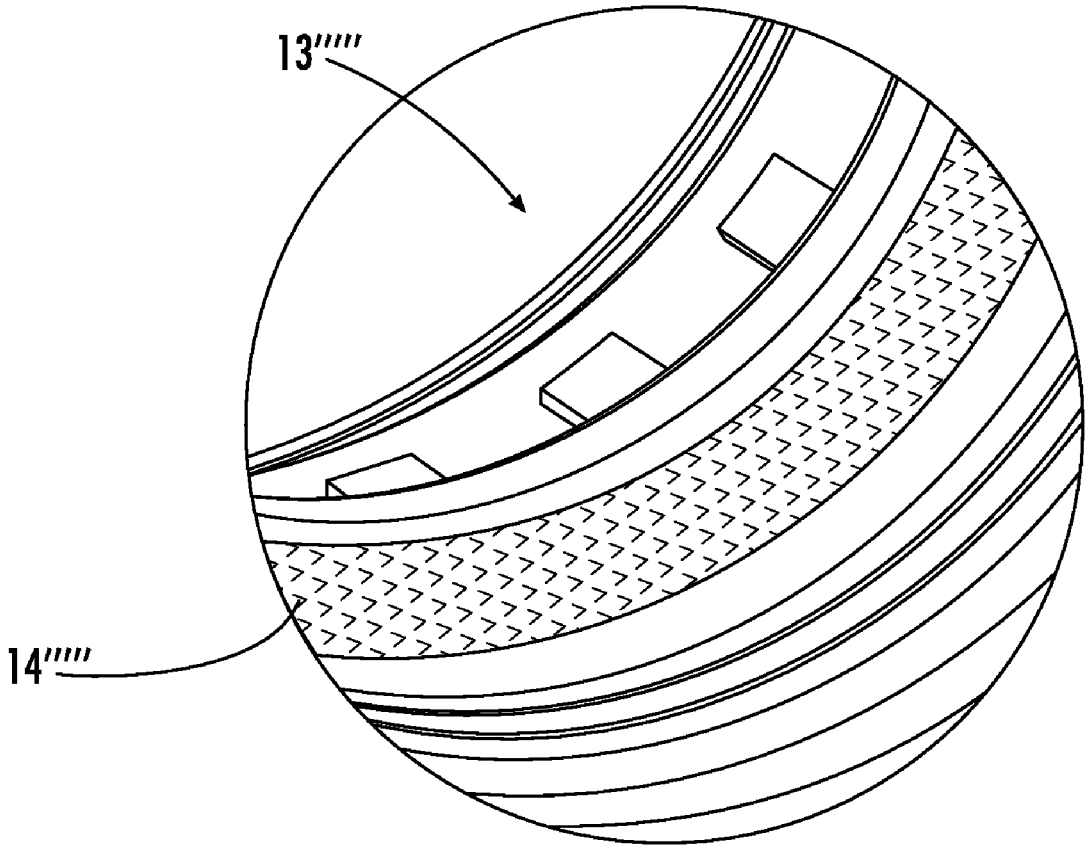
FIG. 19 is a greatly enlarged perspective view of an inner surface and ramp of a back nut of still another embodiment of a connector according to the present invention.

The back nut 13 defines a ramp 14 to receive the outer conductor 31 thereagainst. The ramp 14 illustratively has stair-stepped surface, although the skilled artisan will understand that other ramp surfaces may be used. For example, as shown in the embodiment of FIG. 19, the ramp 14'''' may be defined by a knurled surface of the back nut 13''''.

The end of the coaxial cable 30 is prepared so that the inner conductor 33 extends longitudinally outwardly beyond the end of the outer conductor 31. In addition, in some embodiments (FIG. 1) portions of the dielectric 32 are removed so that the inner surface of the outer conductor 31 is also exposed. The coaxial cable 30 illustratively includes an outer insulation jacket 34 stripped back a distance so that outer end portions of the outer conductor 31 are exposed. The outer conductor 31 is flared outwardly to define the flared end 27.

A portion of the connector housing 12 and a portion of the back nut 13 include respective portions defining a positive stop 18 when fully engaged. More particularly, the connector housing 12 comprises an enlarged diameter tool engaging portion 17 and the back nut 13 comprises a forward end 16. The positive stop 18 is defined by the enlarged diameter tool engaging portion 17 and the forward end 16 of the back nut 13. The forward o-ring 16 is radially inward of and adjacent to the positive stop 18.

It should of course be understood that other variations of the positive stop 18 are possible. Indeed, the connector housing 12 may have a rear portion to engage with a shoulder of the back nut 13 to define the positive stop 18.

The positive stop 18 helps prevent overtightening of the engagement between the connector housing 12 and the back nut 13 that may generate compression and or shearing forces at potentially damaging levels. The positive stop 18 therefore facilitates easy installation of the connector 10 on the coaxial cable 30 by eliminating the need for a torque wrench or other torque limiting tool.

Figure 11:
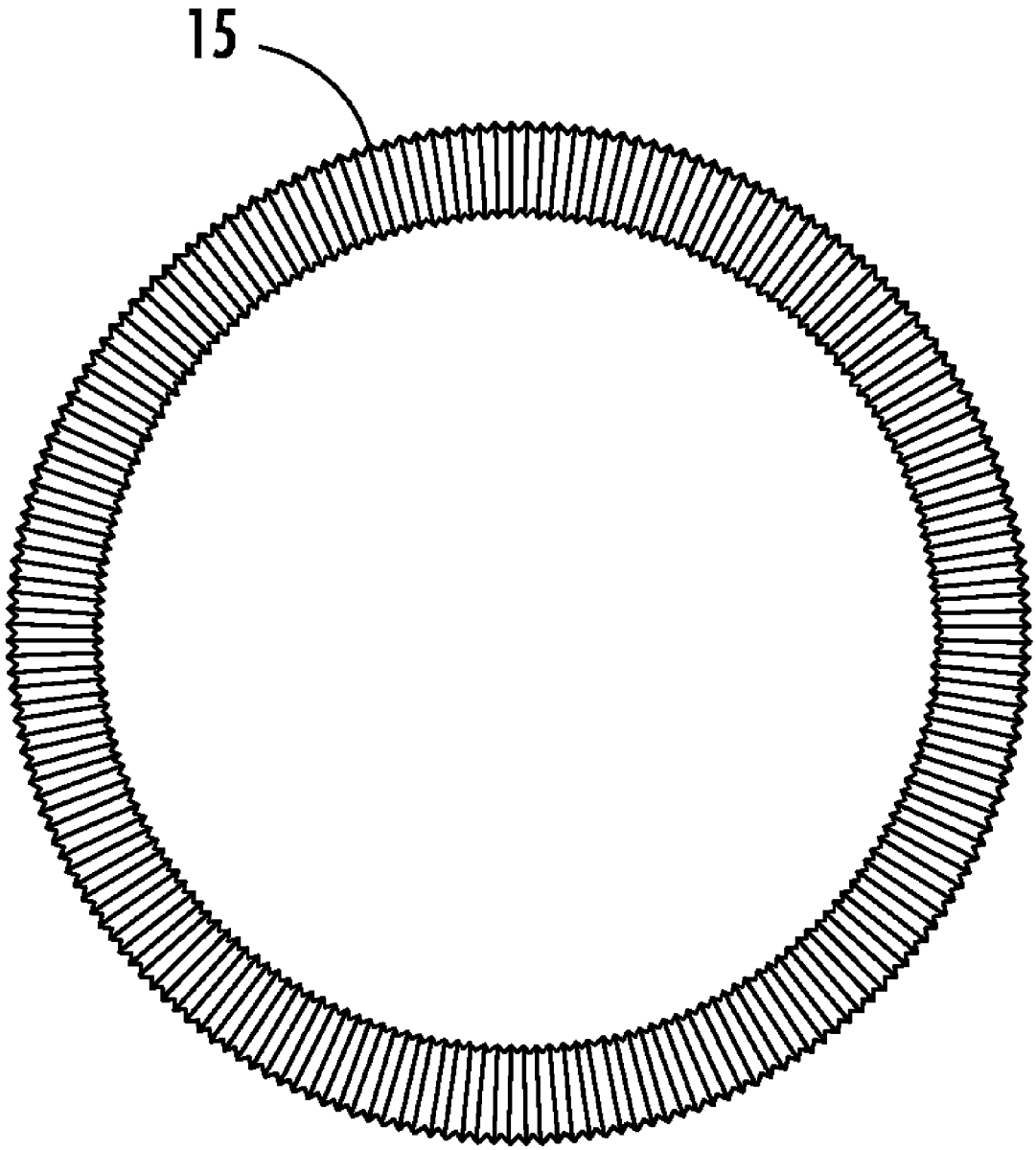
FIG. 11 is a front elevation view of the electrically conductive compressible coil spring of the connector shown in FIG. 1.

The connector housing 12 illustratively has a spring cavity 20 to receive an electrically conductive compressible ring 15 (FIG. 11) defined therein. This electrically conductive compressible ring 15 is perhaps best shown in FIG. 6.

The electrically conductive compressible ring 15 compressibly clamps against the outer conductor 31 opposite the ramp 14 as the connector housing 12 and back nut 13 are engaged. The electrically conductive compressible ring 15 illustratively has an axis coaxial with that of the back nut 13.

This clamping helps to provide an electrical connection between the outer conductor 31 and the ramp 14 by providing a constant contact pressure between the outer conductor and the ramp. By maintaining such a secure electrical connection, the intermodulation distortion of signals traveling through the coaxial cable 30 may be reduced.

The electrically conductive compressible coil spring 15 advantageously maintains a sufficient clamping force on the outer conductor 31 even if the outer conductor changes shape or size due to thermal expansion or aluminum creep, for example, whereas an arrangement of two wedging surfaces to clamp the outer conductor might lose clamping force and contact pressure if the outer conductor were to change shape or size. Furthermore, by maintaining a constant clamping force on the outer conductor 31, the electrically conductive compressible coil spring 15 allows the connector 10 to be used with both smooth wall outer conductor coaxial cables 30 corrugated outer conductor coaxial cables. In addition the electrically conductive compressible coil spring 15 allows the connector 10 to be used on a variety of coaxial cables with different thicknesses, and on a variety of coaxial cables with outer conductors having different thicknesses.

Furthermore, the clamping provided by the electrically conductive compressible coil spring 15 reduces radial movement of the connector 10 about the coaxial cable 30. That is, the electrically conductive compressible coil spring 15 acts as an anti-rotational device, such as a lock washer, to clamp the coaxial cable 30 between the connector housing 12 and back nut 13 and bite into the outer conductor 31 to reduce or prevent rotation of the connector 10 about the coaxial cable 30.

A center contact 26 is supported in the connector housing 12 by the insulator member 24*a*, 24*b* and is electrically connected to the inner conductor 33. The insulator member 24 is also carries the inner conductor 33 of the cable to reduce or prevent movement to thereby reduce IMD.

The illustrated insulator member 24*a*, 24*b* is a two piece unit. Of course, the insulator member 24 may also be a monolithically formed one-piece unit in some applications. Such a monolithic construction would help to reduce the number of connector components and thereby reduce the overall cost of the connector 10.

The back nut 13 includes threads 21 to dig into the jacket 34 to securely attach the back nut to the coaxial cable 30. Of course, those skilled in the art will understand that these threads 21 are optional.

A method aspect is directed to a method of making a connector 10 to be attached to a coaxial cable 30 comprising an inner conductor 33, an outer conductor 31, and a dielectric 32 therebetween. The method comprises forming a connector housing 12 and forming a back nut 13 having a ramp 14 to receive the outer conductor 31 thereagainst and a forward portion to threadingly receives a rearward portion of the connector housing 12 and to define a positive stop 18 therewith when fully engaged with the connector housing.

The method further includes forming an electrically conductive compressible coil spring 15 to be compressibly clamped against the outer conductor 31 opposite the ramp 14, and forming an insulator member 24 to be positioned in the connector housing for carrying a center contact 26 to be coupled to the inner conductor 31.

Figure 2:
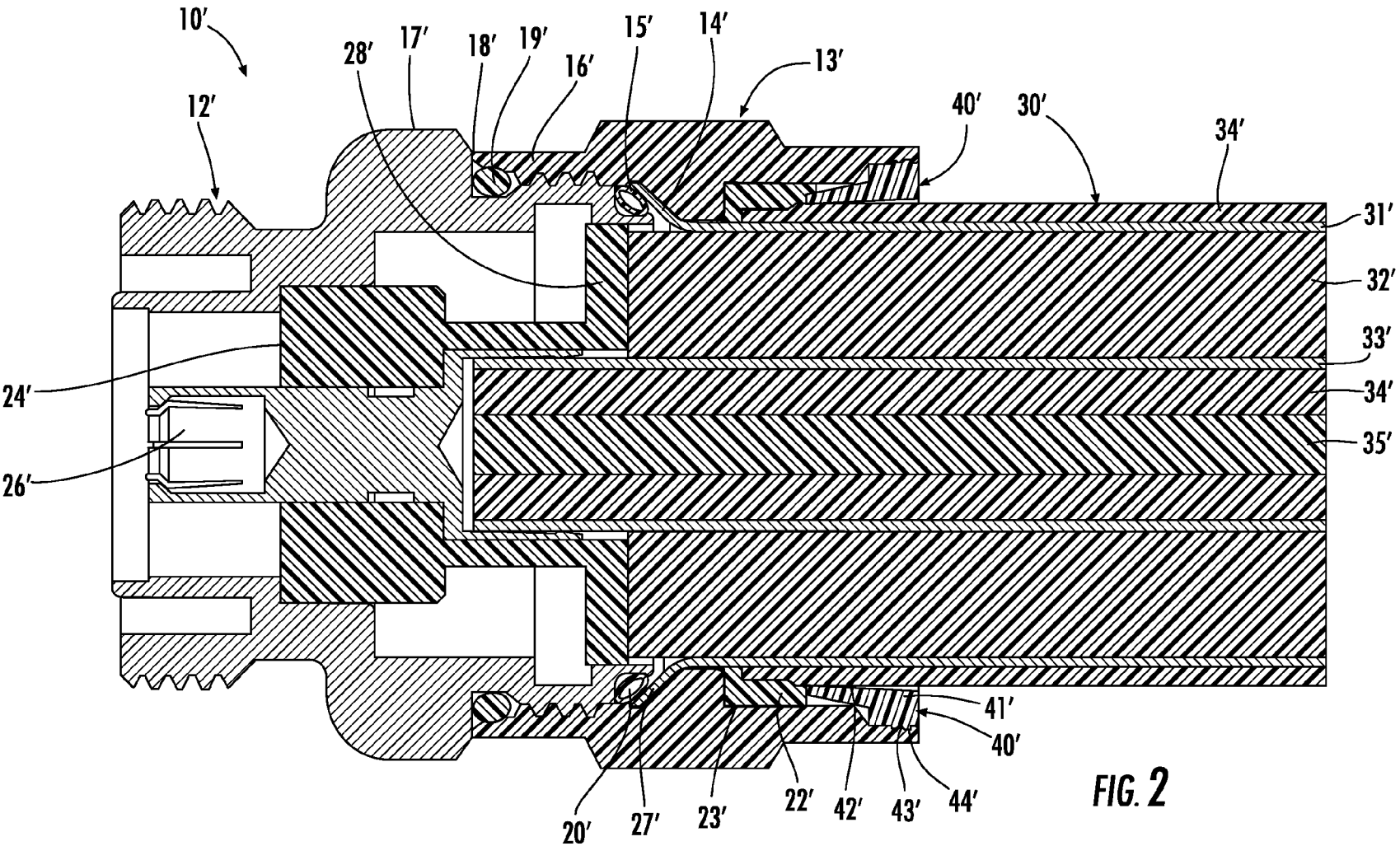
FIG. 2 is a longitudinal cross-sectional view of an alternative embodiment of a connector installed on the end of a coaxial cable having a smooth outer conductor in accordance with the present invention.
Figure 3:
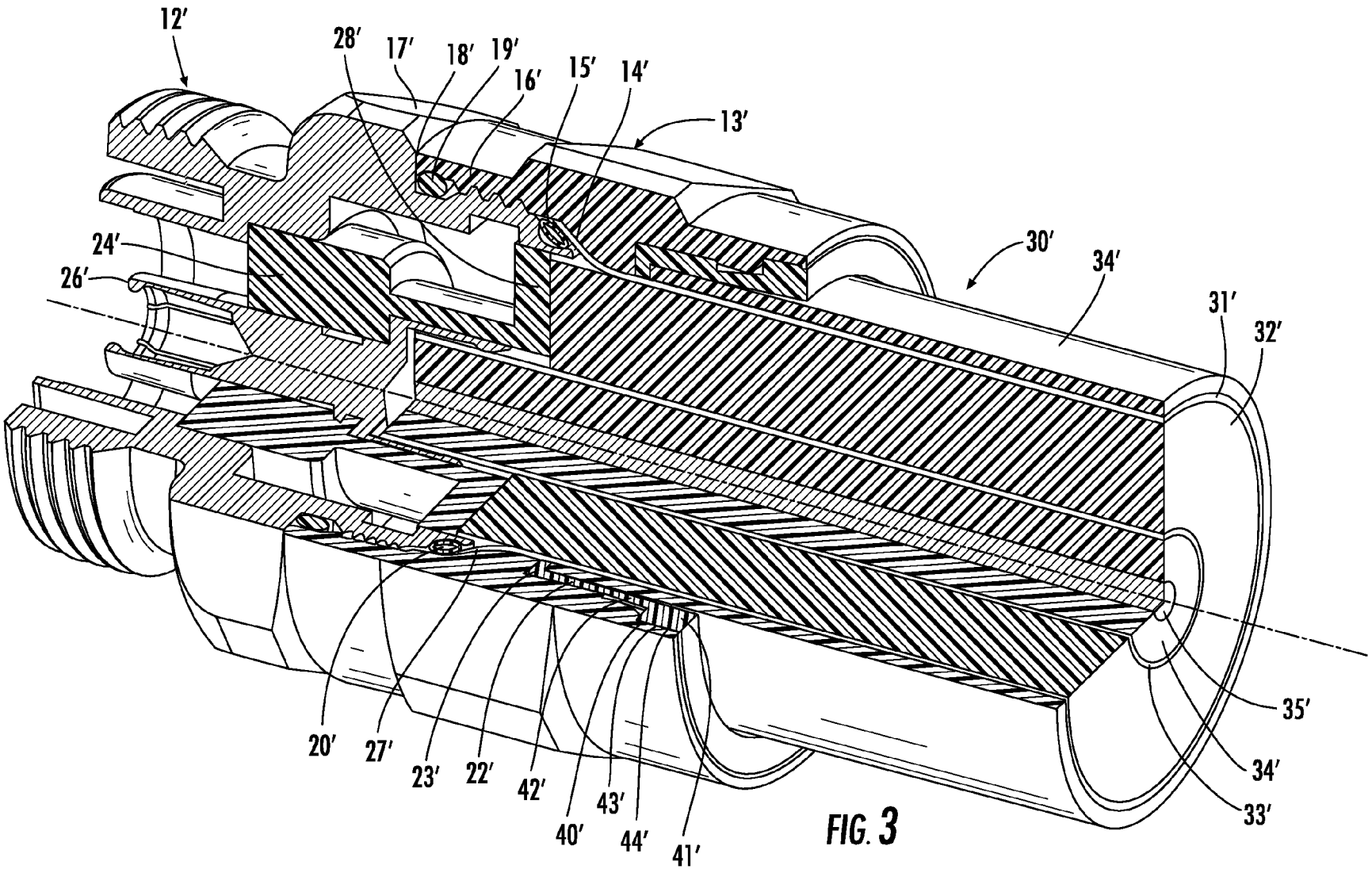
FIG. 3 is a perspective cutaway view of the connector of FIG. 2 installed on the end of a coaxial cable having a smooth outer conductor.
Figure 4:
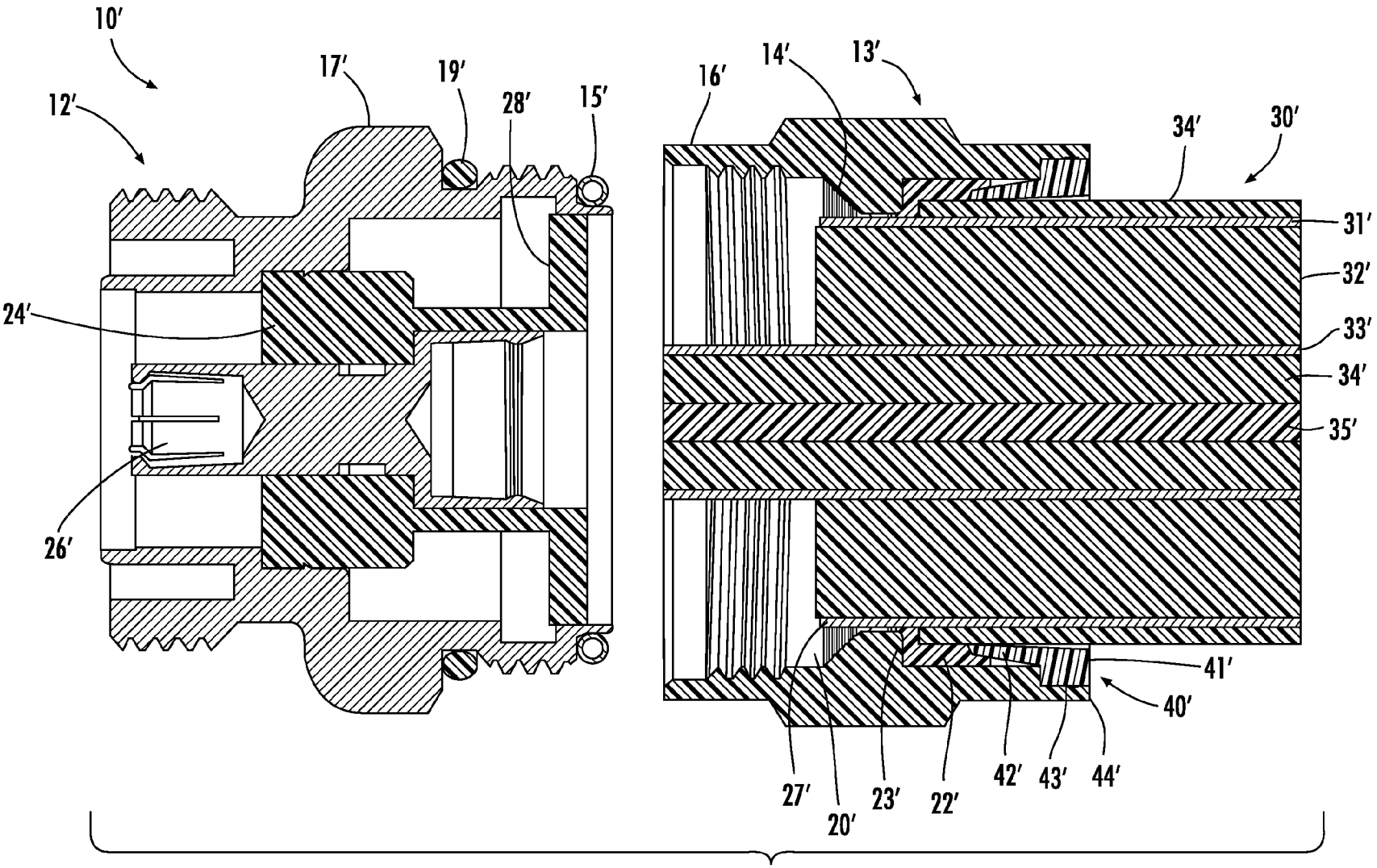
FIG. 4 is an exploded longitudinal cross-sectional view of the connector of FIG. 2.

Those of skill in the art will appreciate that different configurations of the connector housing 12 and back nut 13 may be used. For example, in an embodiment of the connector 10' now described with reference to FIGS. 2-4, the insulator member 24' illustratively includes a rearward portion 28' engaging the dielectric 32' of the coaxial cable 30'.

Figure 10:
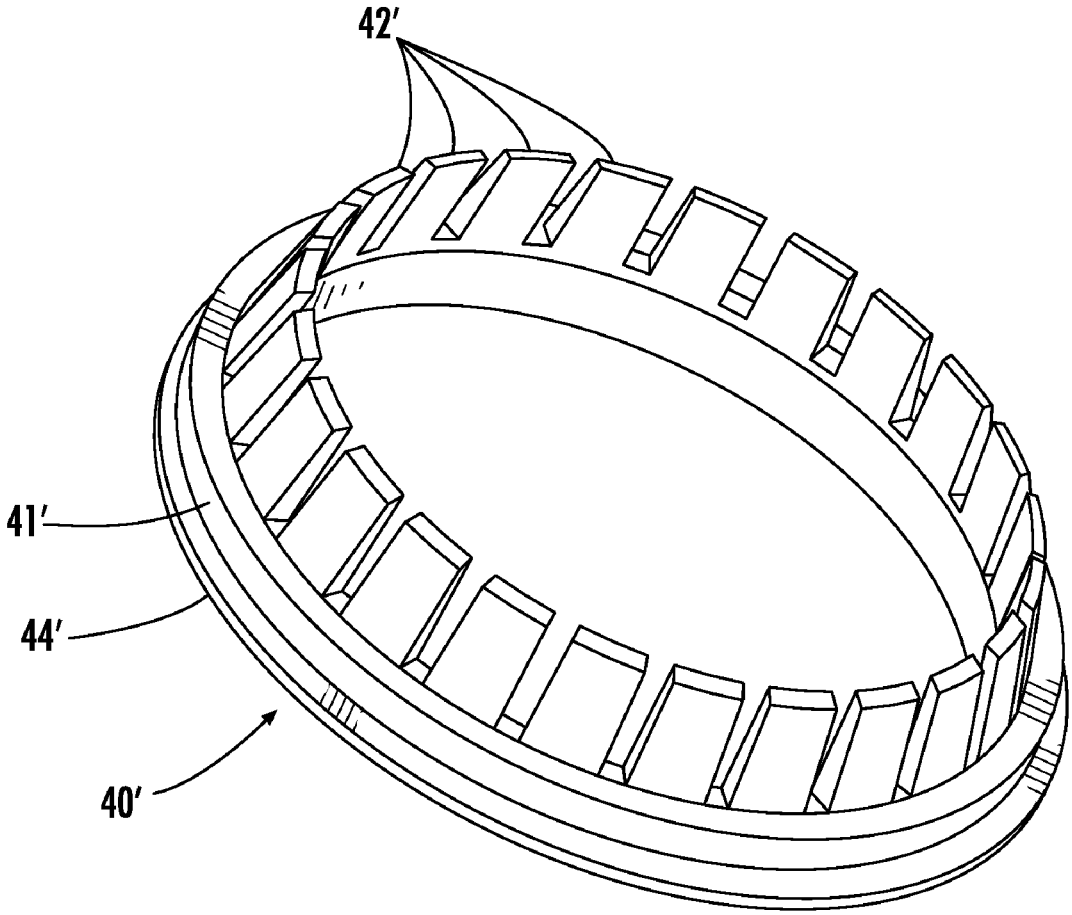
FIG. 10 is perspective view of the retaining ring of the connector shown in FIG. 2.
Figure 12:
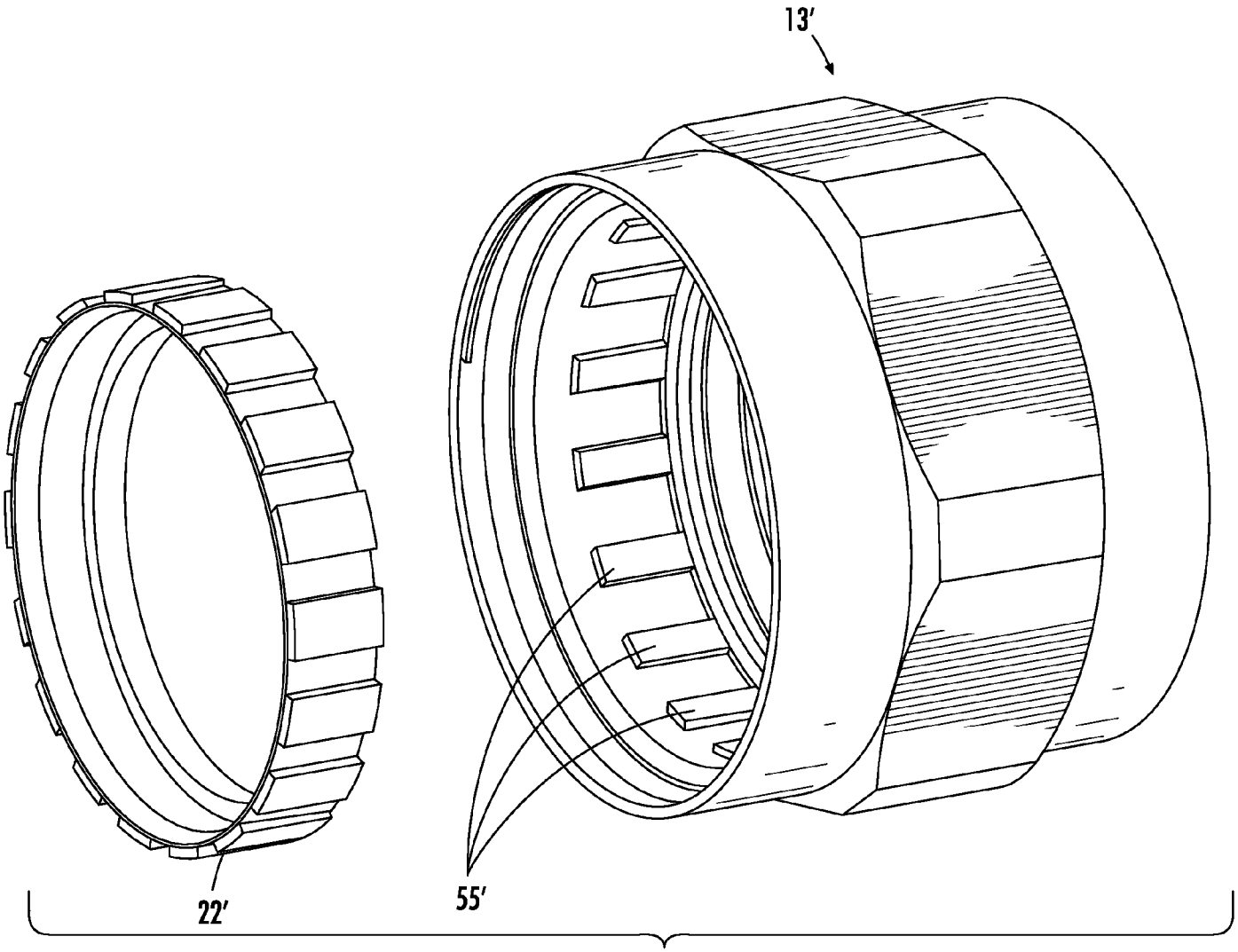
FIG. 12 is an exploded perspective view of the back nut and sealing ring of FIG. 2.

Furthermore, a retaining ring 40' (shown in greater detail in FIG. 10) is carried within the back nut 13' rearwardly of the sealing ring 22' (shown in greater detail in FIG. 12). The sealing ring 22' seals both the jacket 34' and the outer conductor 31'. The sealing ring 40' is compressed radially and longitudinally when the back nut is installed on the coaxial cable 30'.

In some applications, the sealing ring 22' may be molded into the back nut using a two-step molding process. Indeed, the back nut may be formed to have a pattern 55' to facilitate a better bond between the sealing ring 22' and the back nut (FIG. 12).

Similarly, in some applications, the back nut 13' is formed from a polymer composite material and by injection molding. Forming the back nut 13' from a polymer composite material advantageously reduces the cost of the back nut while reducing the formation of galvanic corrosion between the back nut and the outer conductor 31.'

The retaining ring 40' comprises a ring base 41' and a plurality of fingers 42' extending forwardly therefrom so that the sealing ring 40' overlaps the plurality of fingers and urges the plurality of fingers radially inwardly onto the coaxial cable 30' to thereby secure the back nut 13' onto the coaxial cable 30'. The retaining ring 40' securely attaches the back nut 13' on the coaxial cable 30'.

Figure 9:
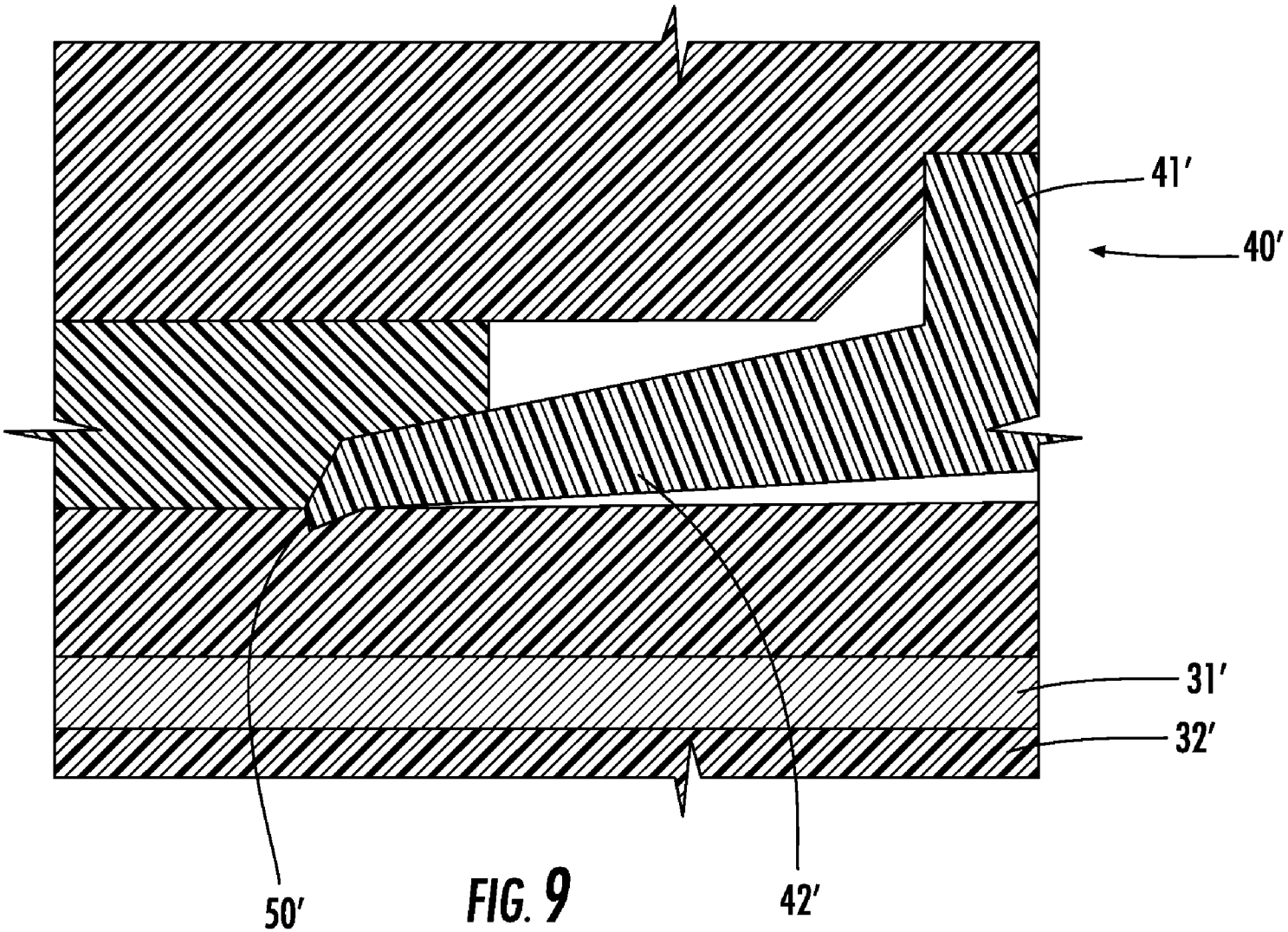
FIG. 9 is a greatly enlarged cross-sectional view of the retaining ring of FIG. 2.

As shown in FIG. 9, each finger has a tooth 50' to dig into the jacket 34' to enhance the secure mechanical connection between the back nut 13' and the coaxial cable 30'. Of courser in some applications, the tooth 50' may not be present and the fingers 42' of the back nut may be configured so as to not score or mark the jacket 34'.

The ring base 41' is a continuous annular base, although of course it need not be continuous in all embodiments. Each of the plurality of fingers 42' illustratively has a rectangular shape.

The back nut 13' and the retaining ring 40' have respective portions defining an interference fit locking arrangement therebetween to limit longitudinal movement of the retaining ring 40' relative to the back nut 13'. This helps to positively located and retain the retaining ring in the back nut.

Figure 8:
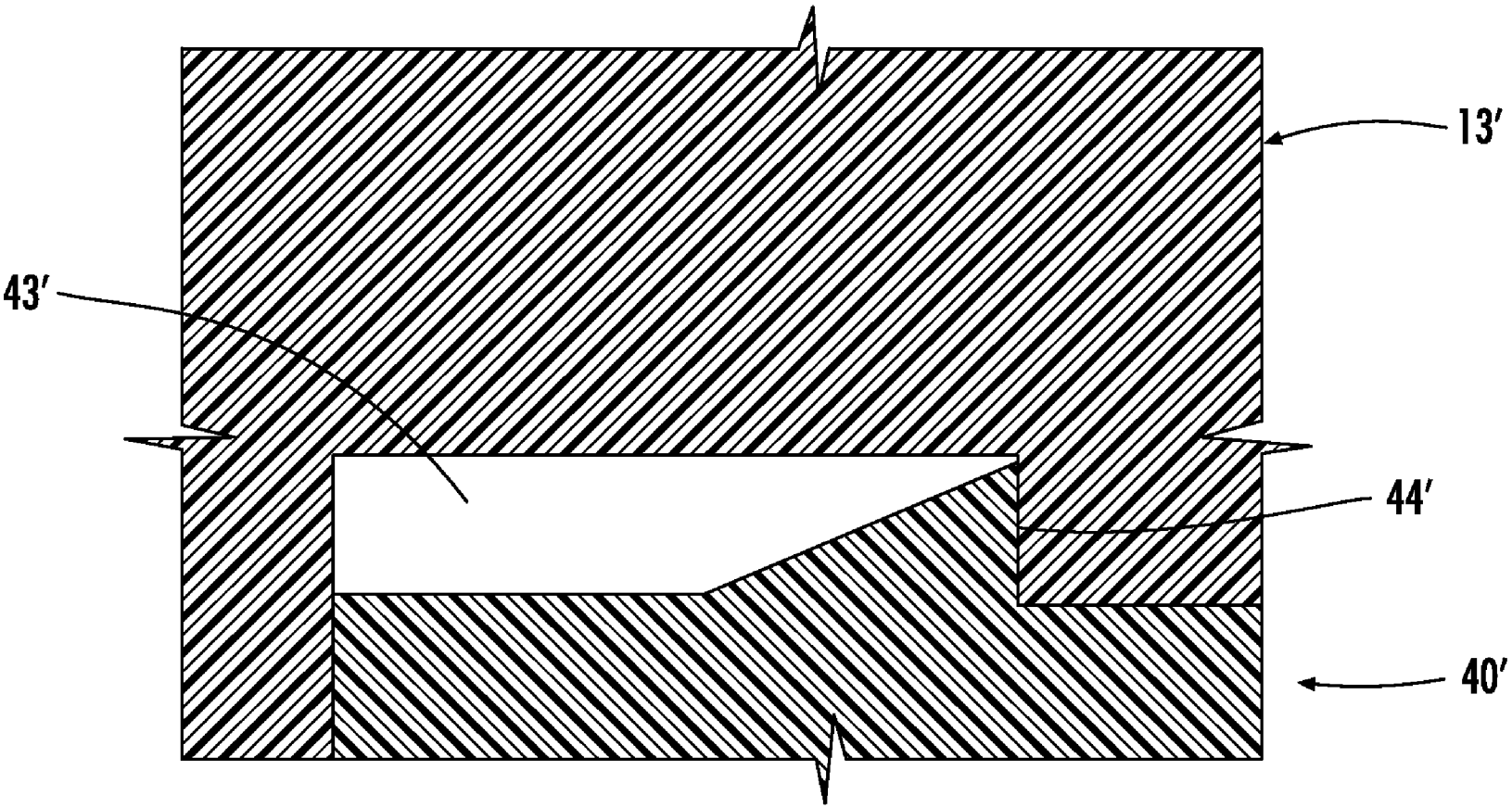
FIG. 8 is a greatly enlarged cross-sectional view of the annular groove and retaining projection of the connector of FIG. 2.
Figure 18:
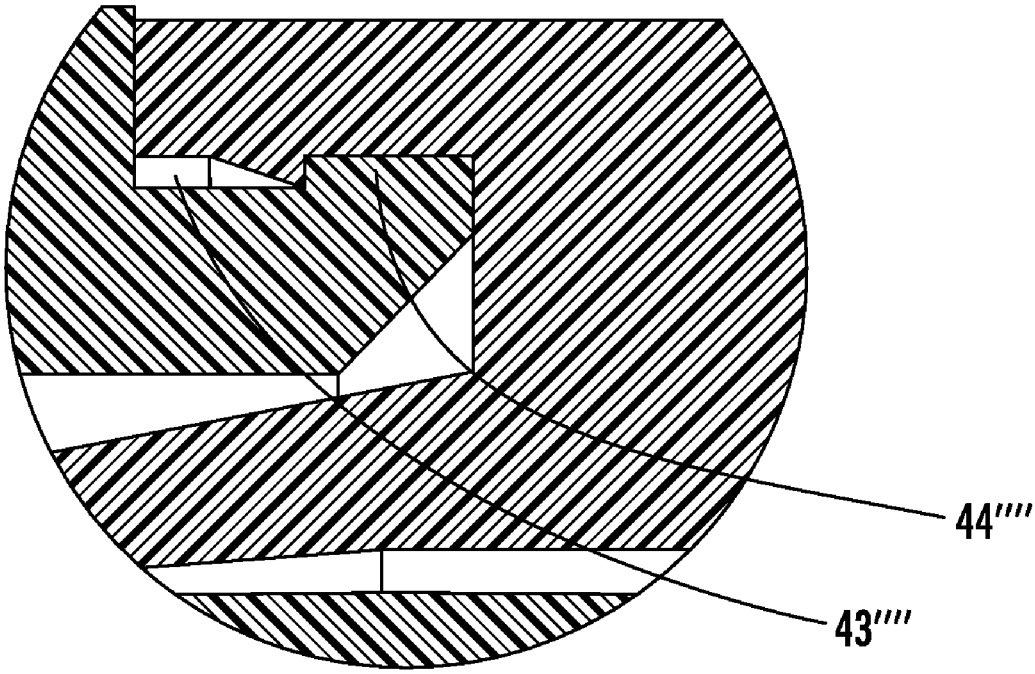
FIG. 18 is a greatly enlarged cross-sectional view of an annular groove and retaining projection of an additional embodiment of a connector according to the present invention.

This interference fit is best shown with additional reference to FIG. 8. The back nut 13' has an annular groove 43' defined on a radially inner surface thereof and the retaining ring 40' has a retaining projection 44' extending radially outwardly from the ring base 41' into the annular groove. Alternatively, as shown in FIG. 18, in some applications, the back nut 13"" may have a retaining projection 44"" to extend into an annular groove 43"" of the retaining ring 40"".

Figure 5:
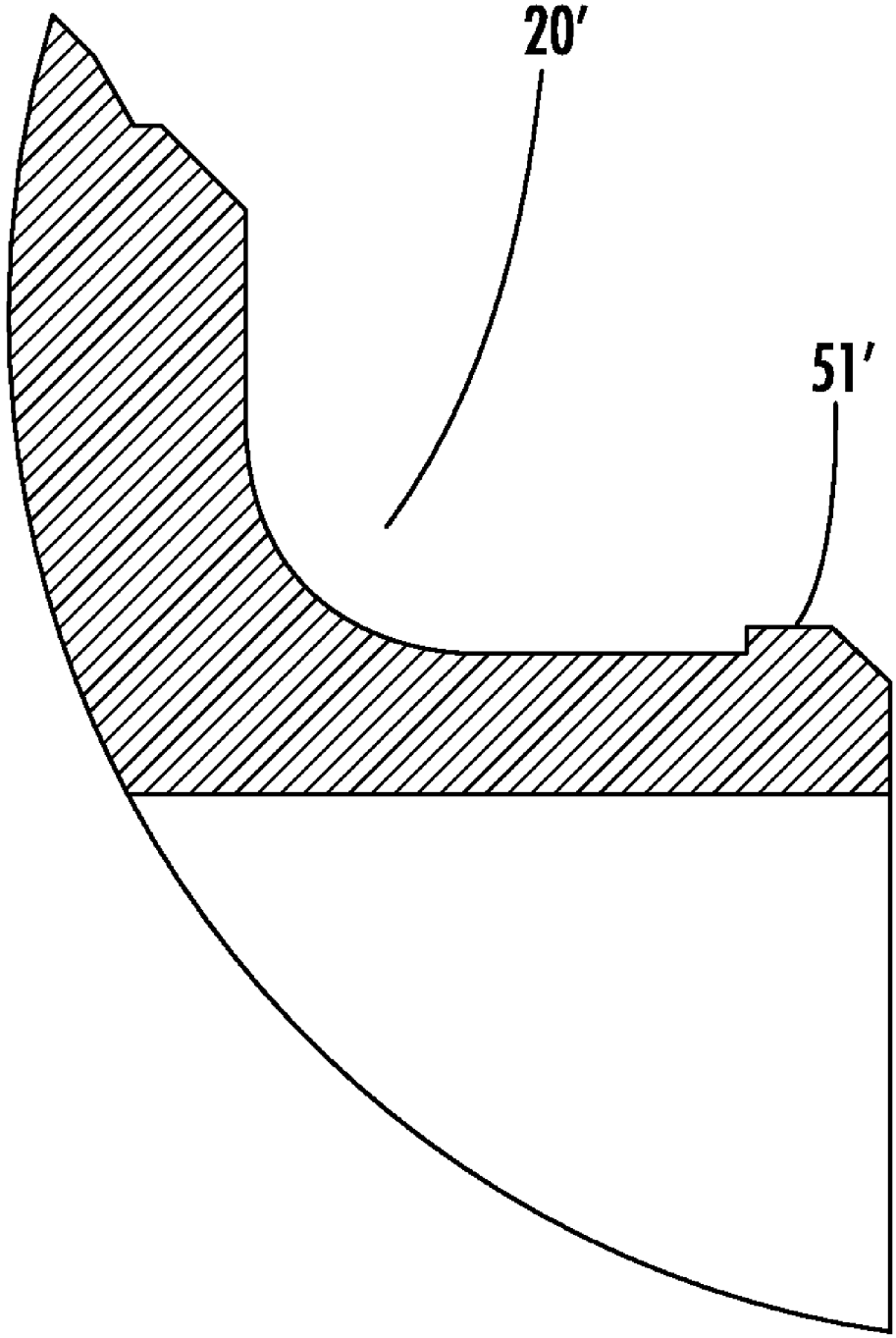
FIG. 5 is a greatly enlarged longitudinal cross sectional view of the spring cavity of the connector of FIG. 2 wherein the electrically conductive compressible coil spring is not shown for clarity.

As perhaps best shown in FIG. 5, the spring cavity 20' includes an enlarged diameter portion 51' to capture the electrically compressible conductive coil spring 15' and to prevent longitudinal movement thereof.

Figure 6:
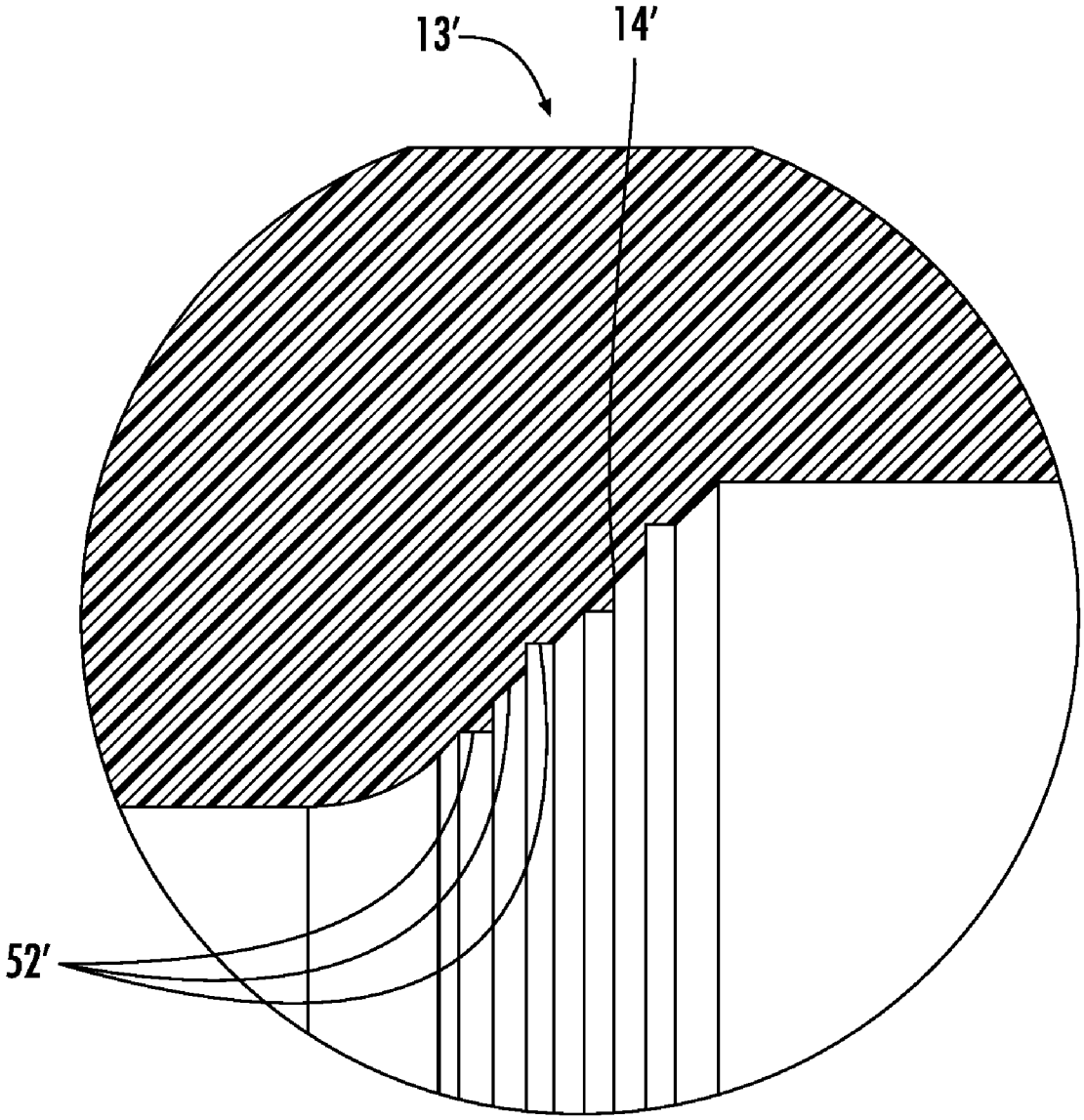
FIG. 6 is a greatly enlarged longitudinal cross sectional view of the ramp of the connector of FIG. 2 wherein the electrically conductive compressible coil spring is not shown for clarity.
Figure 7:
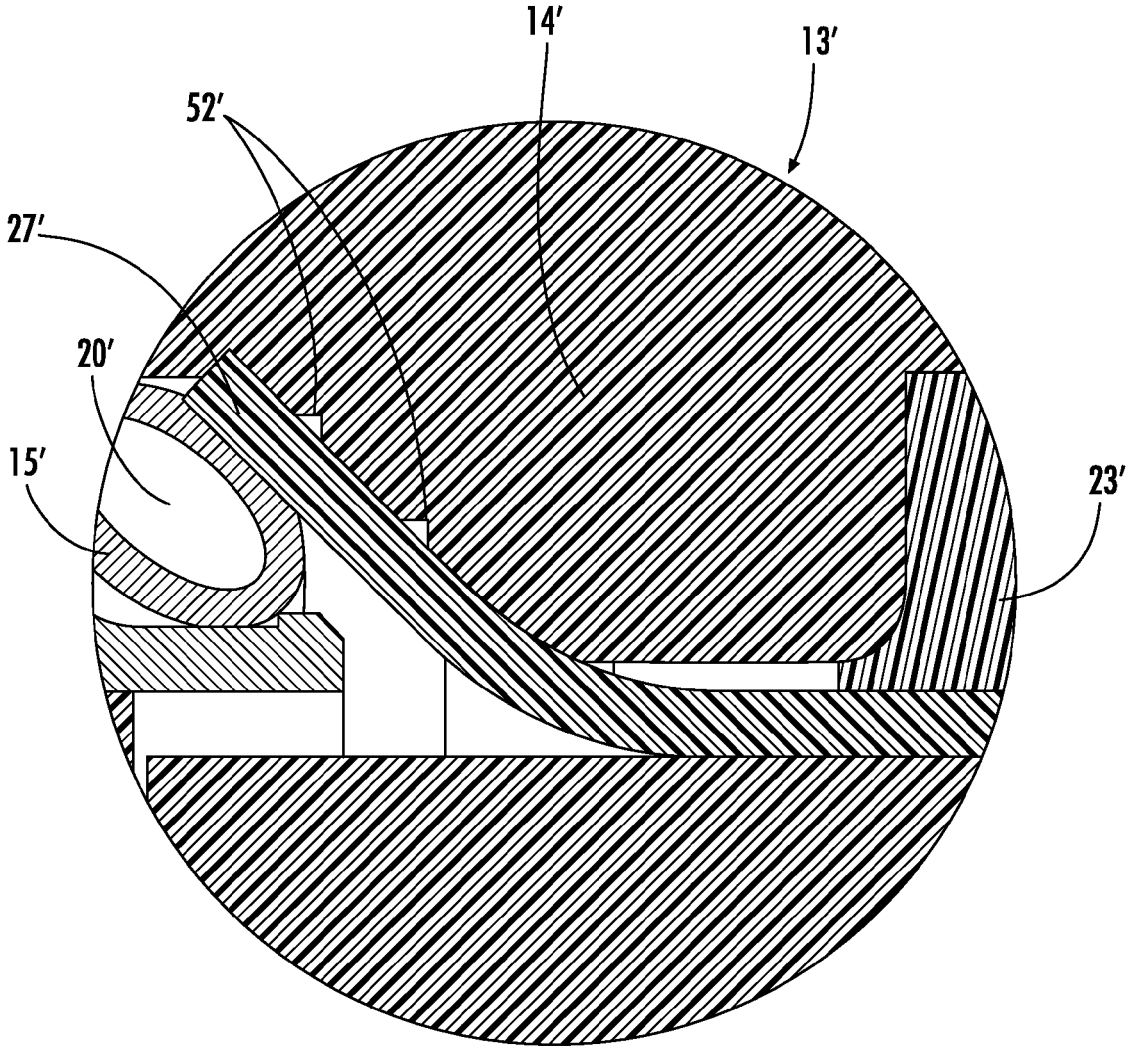
FIG. 7 is a greatly enlarged longitudinal cross sectional view of the ramp of the connector of FIG. 2 wherein the electrically conductive compressible coil spring is shown.

Shown in FIGS. 6-7 is the ramp 14', which illustratively has an outer conductor adhesive removing feature 52'. This outer conductor adhesive removing feature 52' comprises a series of sharp projections and recesses to help remove any residual adhesive from the outer conductor 31' as the back nut 13' is installed on the coaxial cable 30'.

The sealing ring 23' may comprise an elastomeric material, such as an electrically insulating rubber material. The retaining ring 40' may comprise an electrically insulating plastic material, but could be other materials as well.

Furthermore, the retaining ring 40' may be rotated in the annular groove 43' so that the back nut 13' is rotatable about the retaining ring when installed on the coaxial cable 30'. Thus, during connector 10 installation, a technician holds the connector housing 12' stationary and rotates the back nut 13' onto the connector housing 12'. Rotation of the back nut 13' onto the connector housing 12' helps to avoid the creation of metal chips that would be caused by rotation of the center contact 26' about the inner conductor 33' during installation. Such loose metal chips may increase intermodulation distortion.

Of course, in some applications, the retaining ring 40' may be securely fastened into the back nut 13' so that it may not be rotated in the annular groove 43'. In this case, a technician may hold the back nut 13' stationary and may instead thread the connector housing 12' into the back nut. Such a configuration may provide a tighter mechanical connection between the retaining ring 40' and the back nut. Other elements not specifically mentioned are indicated with prime notation and are similar to the elements described above with reference to FIG. 1. Accordingly, those other elements require no further description herein.

Figure 13:
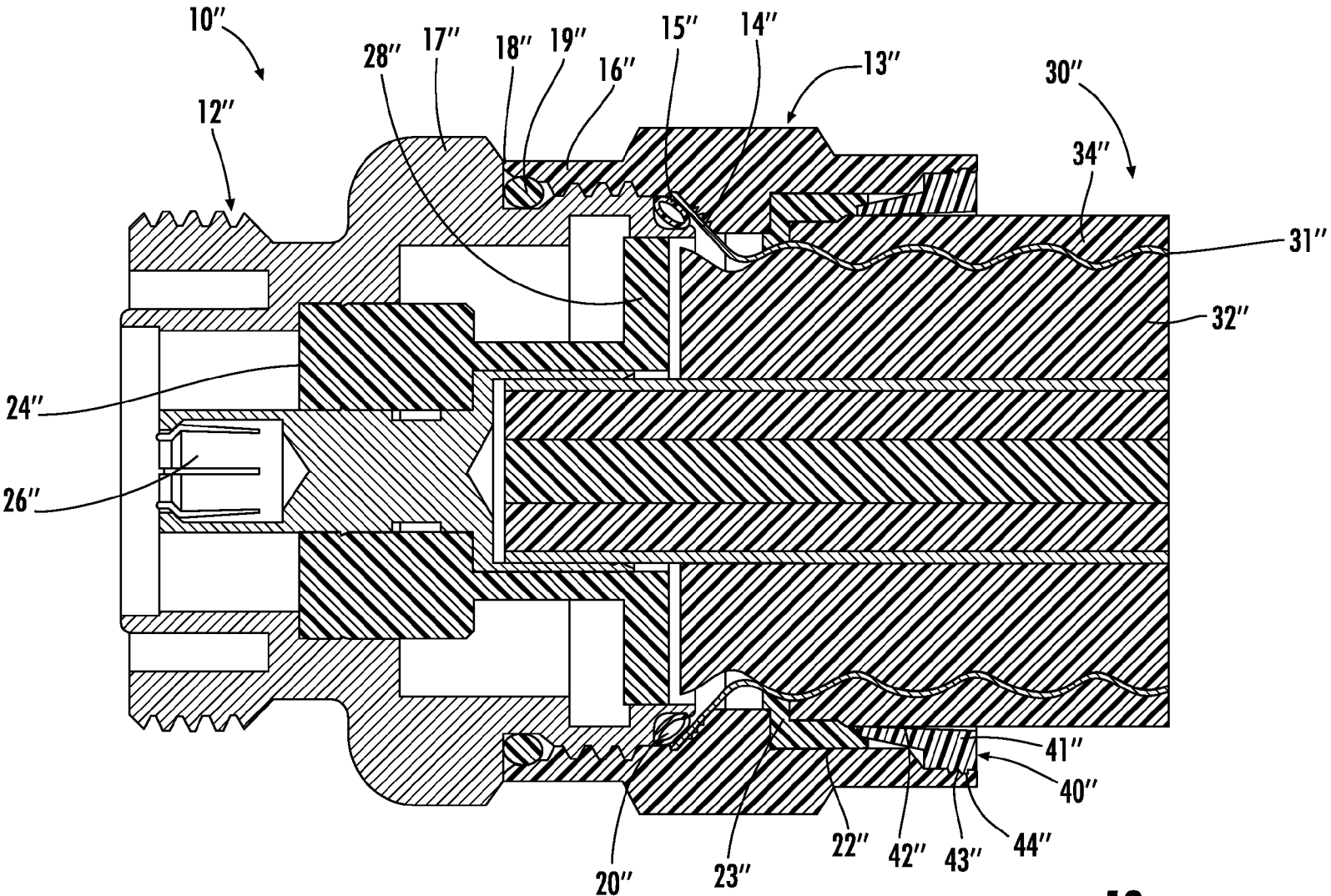
FIG. 13 is a longitudinal cross-sectional view of yet another embodiment of a connector installed on the end of a coaxial cable having a corrugated outer conductor in accordance with the present invention.
Figure 14:
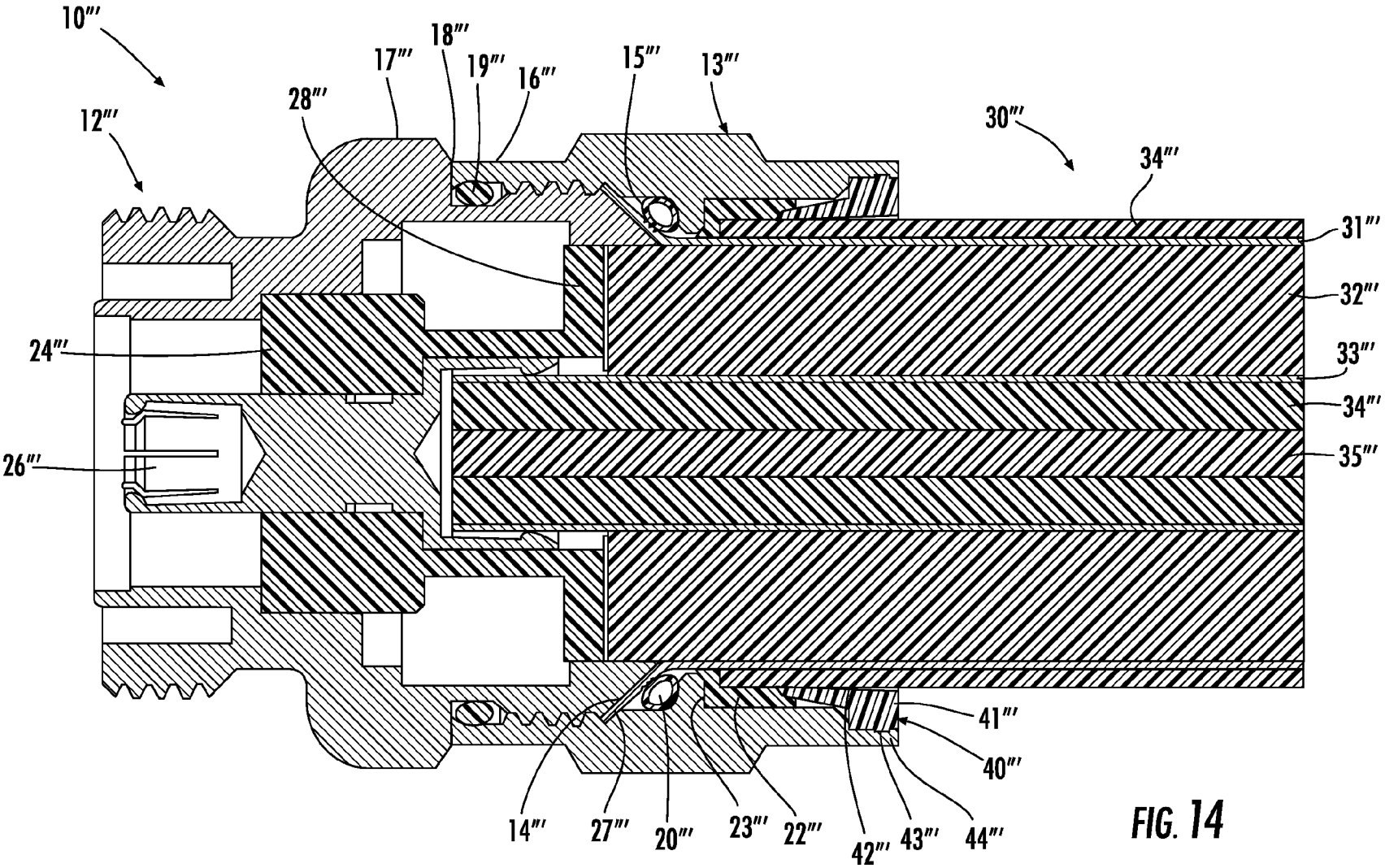
FIG. 14 is a longitudinal cross-sectional view of a further embodiment of a connector installed on the end of a coaxial cable having a smooth outer conductor in accordance with the present invention.
Figure 15:
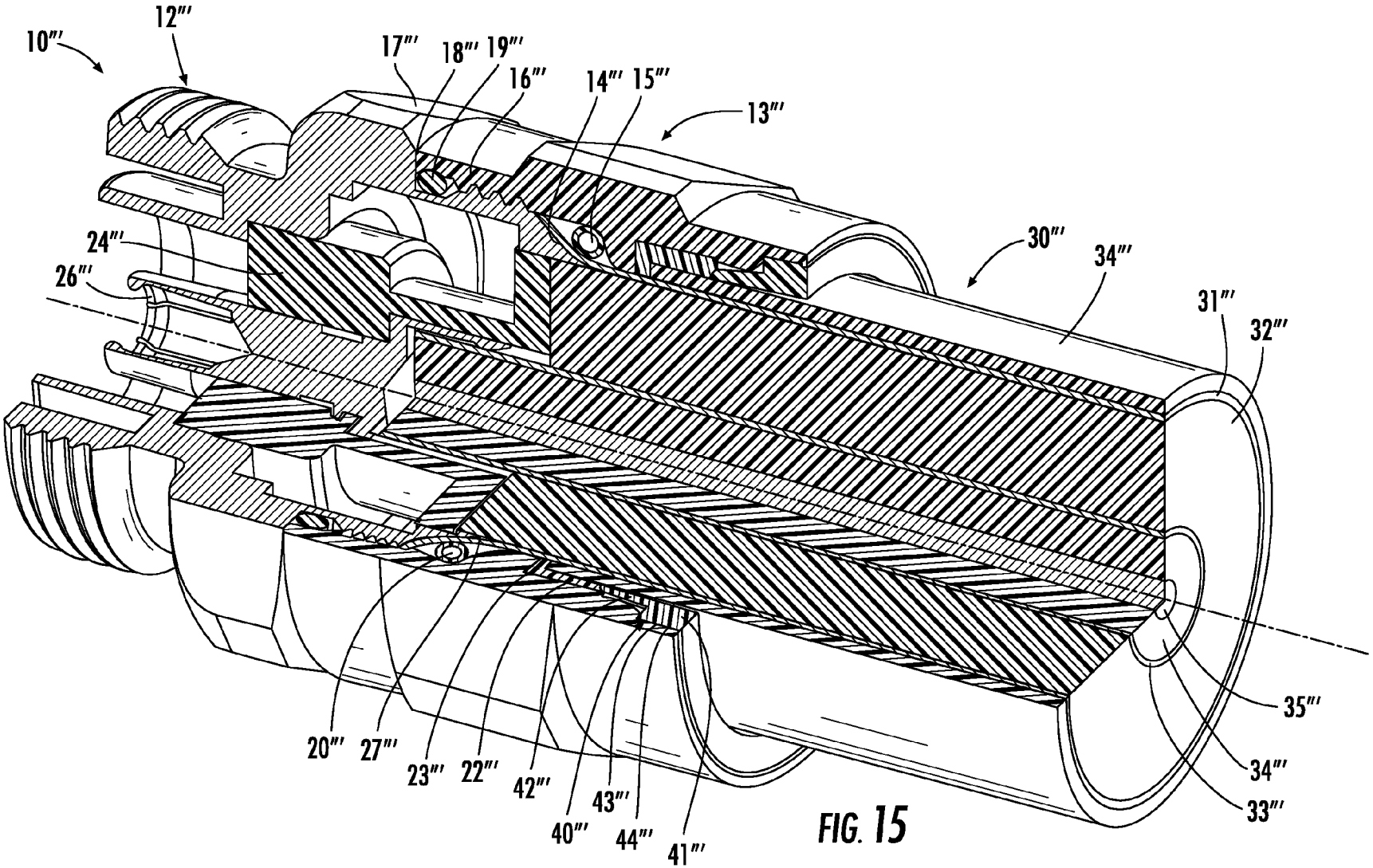
FIG. 15 is a perspective cutaway view of the connector of FIG. 14 installed on the end of a coaxial cable having a smooth outer conductor.
Figure 16:
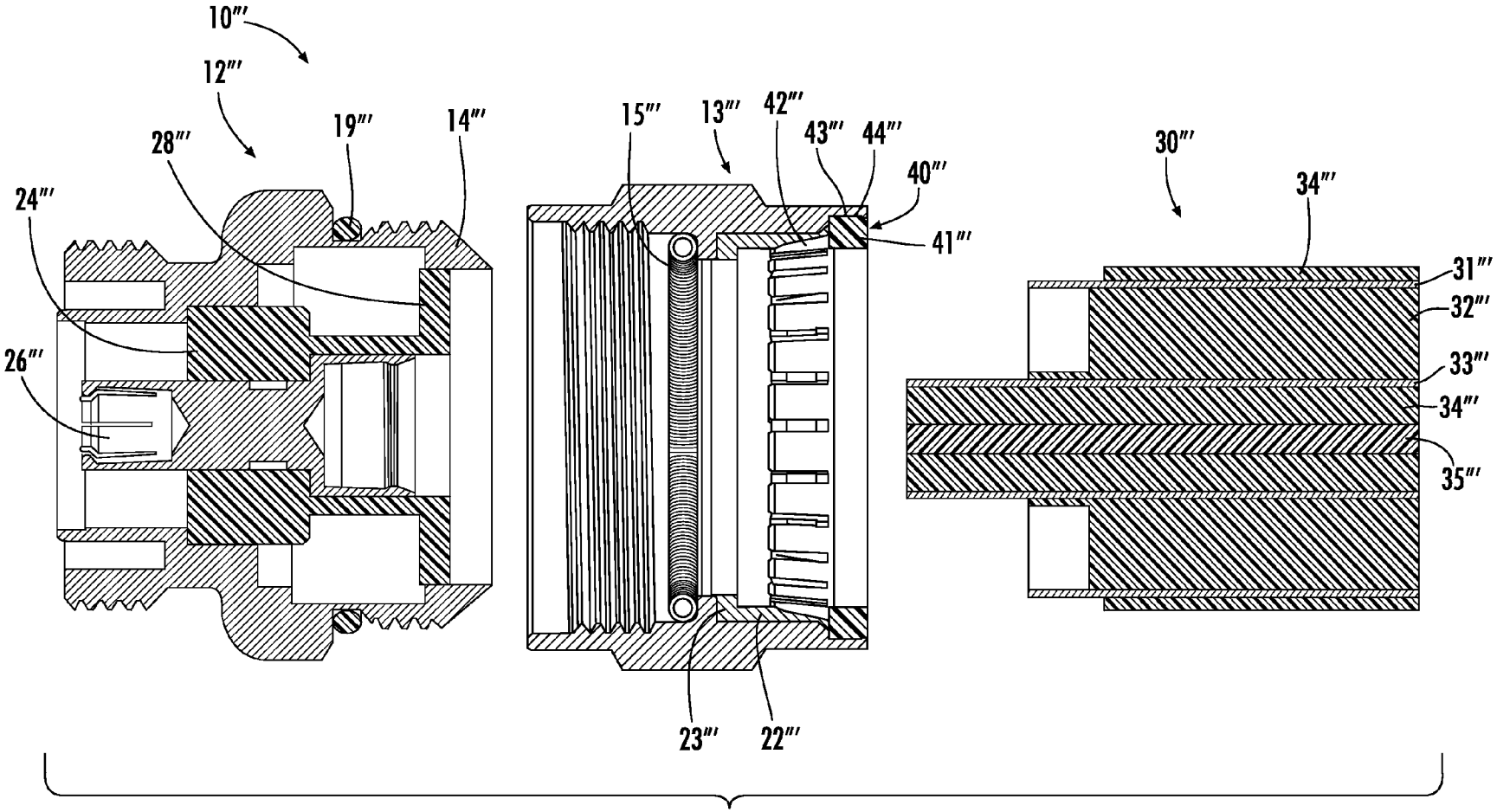
FIG. 16 is an exploded longitudinal cross-sectional view of the connector of FIG. 14.

As shown in the embodiment illustrated in FIG. 13, the connector 10" may be installed on the end of a coaxial cable 30" having a corrugated outer conductor 31". Those other elements not specifically mentioned are indicated with double prime notation and are similar to the elements described above with reference to FIG. 2. Accordingly, those other elements require no further description herein.

Figure 17:
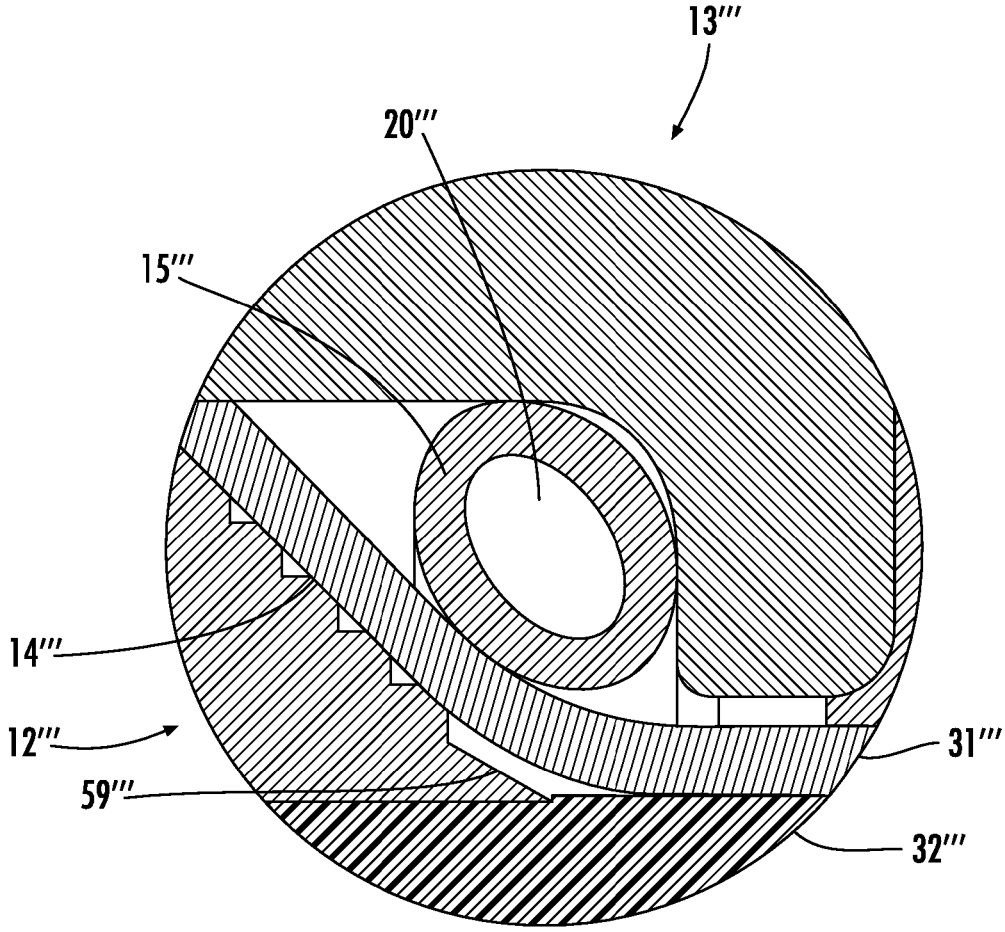
FIG. 17 is a greatly enlarged cross-sectional view of the ramp of the connector of FIG. 14.

Those of skill in the art will appreciate that yet more configurations of the connector housing 12 and back nut 13 may be used. For example, in an embodiment of the connector 10'" illustrated in FIGS. 14-17, the connector housing 12'" (rather than the back nut 13'") defines the ramp 14'". Furthermore, the ramp 14'" has a wedging portion 59'" (FIG. 17) to flare the outer conductor 31'" during attachment of the connector housing 12'" to the coaxial cable 30'". In addition, the stair-stepped shape of the ramp 14'" removes residual adhesive or glue from the inner conductor 31'" during attachment.

Those other elements not specifically mentioned are indicated with triple prime notation and are similar to the elements described above with reference to FIG. 2. Accordingly, those other elements require no further description herein.

Other details of such connectors 10 for coaxial cables 30 may be found in co-pending applications CONNECTOR WITH POSITIVE STOP FOR COAXIAL CABLE AND ASSOCIATED METHODS, Ser. No. 12/277,103, CONNECTOR INCLUDING COMPRESSIBLE RING FOR COAXIAL CABLE AND ASSOCIATED METHODS, Ser. No. 12/277,125, FLARING COAXIAL CABLE END PREPARATION TOOL AND ASSOCIATED METHODS, Ser. No. 12/277,152, and CONNECTOR WITH POSITIVE STOP AND COMPRESSIBLE RING FOR COAXIAL CABLE AND ASSOCIATED METHODS, Ser. No. 12/277,162, the entire disclosures of which are hereby incorporated by reference.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A coaxial cable connector to be attached to a coaxial cable comprising an inner conductor, an outer conductor, and a dielectric therebetween, the coaxial cable connector comprising:

a back nut to be secured onto the coaxial cable;

a connector housing to be coupled to said back nut;

a center contact to be coupled to the inner conductor;

at least one insulator member within said connector housing for carrying said center contact;

a sealing ring carried within said back nut; and a retaining ring carried within said back nut rearwardly of said sealing ring and comprising a ring base and a plurality of fingers extending forwardly therefrom so that said sealing ring overlaps said plurality of fingers and urges said plurality of fingers radially inwardly onto the coaxial cable to thereby secure said back nut onto the coaxial cable.

2. The coaxial cable connector of claim 1 wherein said back nut and said retaining ring have respective portions defining an interference fit locking arrangement therebetween.

3. The coaxial cable connector of claim 2 wherein said back nut has an annular groove defined on a radially inner surface thereof; and wherein said retaining ring further comprises a retaining projection extending radially outwardly from said ring base into the annular groove.

4. The coaxial cable connector of claim 2 wherein said back nut comprises a retaining projection extending therefrom; and wherein an annular groove is defined on a radially outer surface of said ring base to receive said retaining projection.

5. The coaxial cable connector of claim 1 wherein said ring base comprises a continuous annular ring base.

6. The coaxial cable connector of claim 1 wherein said sealing ring comprises a radially inwardly extending forward end to seal against an exposed portion of the outer conductor of the coaxial cable.

7. The coaxial cable connector of claim 1 wherein the coaxial cable further comprises a jacket surrounding the outer conductor; and wherein said sealing ring comprises a radially inwardly extending forward end to seal against an exposed portion of the jacket.

8. The coaxial cable connector of claim 1 wherein each of said plurality of fingers has a rectangular shape.

9. The coaxial cable connector of claim 1 wherein said sealing ring comprises an elastometric material.

10. The coaxial cable connector of claim 1 wherein the retaining ring comprises a polymer material.

11. The coaxial cable connector of claim 1 wherein said connector housing defines a ramp to receive the outer conductor thereagainst; and further comprising a clamping ring to compressibly clamp against the outer conductor opposite the ramp when the connector housing and back nut are engaged.

12. The coaxial cable connector of claim 11 wherein the ramp has a first portion and a second portion, an angle of the first portion with respect to a longitudinal axis of the connector housing being less than an angle of the second portion with respect to the longitudinal axis of the connector housing.

13. The coaxial cable connector of claim 1 wherein said back nut defines a ramp to receive the outer conductor thereagainst; and further comprising an electrically conductive compressible coil spring having an axis coaxial with said back nut to compressibly clamp against the outer conductor opposite the ramp when the connector housing and back nut are engaged.

14. The coaxial cable connector of claim 1 wherein said connector housing and said back nut include respective portions defining a positive stop when fully engaged.

15. The coaxial cable connector of claim 10 wherein said connector housing comprises an enlarged diameter tool engaging portion; wherein said back nut comprises a forward end; and wherein the positive stop is defined by said enlarged diameter tool engaging portion and said forward end.

16. The coaxial cable connector of claim 1 wherein said back nut comprises a polymer composite back nut.

17. A coaxial cable connector to be attached to a coaxial cable comprising an inner conductor, an outer conductor, and a dielectric therebetween, the coaxial cable connector comprising:

a back nut to be secured onto the coaxial cable;

a connector housing to be coupled to said back nut;

a center contact to be coupled to the inner conductor;

at least one insulator member within said connector housing for carrying said center contact;

a sealing ring carried within said back nut; and a retaining ring carried within said back nut rearwardly of said sealing ring and comprising a continuous annular ring base and a plurality of fingers extending forwardly therefrom so that said sealing ring overlaps said plurality of fingers and urges said plurality of fingers radially inwardly onto the coaxial cable to thereby secure said back nut onto the coaxial cable;

said back nut and said retaining ring having respective portions defining an interference fit locking arrangement therebetween.

18. The coaxial cable connector of claim 17 wherein said back nut has an annular groove defined on a radially inner surface thereof; wherein said retaining ring further comprises a retaining projection extending radially outwardly from said ring base into the annular groove.

19. The coaxial cable connector of claim 17 wherein said ring base comprises a continuous annular ring base.

20. The coaxial cable connector of claim 17 wherein said sealing ring comprises a radially inwardly extending forward end to seal against an exposed portion of the outer conductor of the coaxial cable.

21. The coaxial cable connector of claim 17 wherein each of said plurality of fingers has a rectangular shape.

22. The coaxial cable connector of claim 17 wherein said connector housing defines a ramp to receive the outer conductor thereagainst; and further comprising an electrically conductive clamping ring having an axis coaxial with said connector housing to compressibly clamp against the outer conductor opposite the ramp when the connector housing and back nut are engaged.

23. The coaxial cable connector of claim 17 wherein said back nut defines a ramp to receive the outer conductor thereagainst; and further comprising an electrically conductive clamping ring having an axis coaxial with said back nut to compressibly clamp against the outer conductor opposite the ramp when the connector housing and back nut are engaged.

24. The connector of claim 17 wherein said connector housing comprises an enlarged diameter tool engaging portion; wherein said back nut comprises a forward end; and wherein a positive stop is defined by said enlarged diameter tool engaging portion and said forward end when said connector housing and said back nut are fully engaged.

25. A method of making a coaxial cable connector to be attached to a coaxial cable comprising an inner conductor, an outer conductor, and a dielectric therebetween, the method comprising:

forming a back nut to be secured onto the coaxial cable;

forming a connector housing to be coupled to the back nut;

forming at least one insulator member to be positioned in the connector housing carrying a center contact to be coupled to the inner conductor;

forming a sealing ring to be positioned within the back nut; and forming a retaining ring to be positioned in the back nut rearwardly of the sealing ring and comprising a ring base and a plurality of fingers extending forwardly therefrom so that the sealing ring overlaps the plurality of fingers and urges the plurality of fingers radially inwardly onto the coaxial cable to thereby secure the back nut onto the coaxial cable.

26. The method of claim 25 wherein the back nut and the retaining ring have respective portions defining an interference fit locking arrangement therebetween.

27. The method of claim 26 wherein the back nut has an annular groove defined on a radially inner surface thereof; and wherein the retaining ring further comprises a retaining projection extending radially outwardly from the ring base into the annular groove.

28. The method of claim 25 wherein the ring base comprises a continuous annular ring base.

29. The method of claim 25 wherein the sealing ring comprises a radially inwardly extending forward end to seal against an exposed portion of the outer conductor of the coaxial cable.

* * * * *

UNITED STATES PATENT AND TRADEMARK OFFICE

CERTIFICATE OF CORRECTION

PATENT NO. : 7,635,283 B1
APPLICATION NO. : 12/277172
DATED : December 22, 2009
INVENTOR(S) : Islam et al.

It is certified that error appears in the above-identified patent and that said Letters Patent is hereby corrected as shown below:

| | |
|---|---|
| Column 2, Line 65 | Delete: "conductor the sealing"<br>Insert: --conductor. The sealing-- |
| Column 5, Line 32 | Delete: "oaring"<br>Insert: --o-ring-- |
| Column 6, Line 52 | Delete: "is" |
| Column 7, Line 4 | Delete: "receives"<br>Insert: --receive-- |
| Column 7, Line 47 | Delete: "courser"<br>Insert: --course-- |
| Column 7, Line 59 | Delete: "located"<br>Insert: --locate-- |

Signed and Sealed this

Thirty-first Day of August, 2010

David J. Kappos

David J. Kappos
*Director of the United States Patent and Trademark Office*